US006372017B1

(12) United States Patent
Maddan

(10) Patent No.: US 6,372,017 B1
(45) Date of Patent: Apr. 16, 2002

(54) METHOD FOR PRODUCING MAGNESIUM

(76) Inventor: Orville Lee Maddan, 1941 Bishop Rd., Ft. Walton Beach, FL (US) 32547

( * ) Notice: Subject to any disclaimer, the term of this patent is extended or adjusted under 35 U.S.C. 154(b) by 0 days.

(21) Appl. No.: 09/499,602

(22) Filed: Feb. 7, 2000

(51) Int. Cl.[7] ..... C22B 26/22
(52) U.S. Cl. ..... 75/596
(58) Field of Search ..... 75/596

(56) References Cited

U.S. PATENT DOCUMENTS

| | | | | |
|---|---|---|---|---|
| 3,250,691 A | 5/1966 | Broun, Jr. et al. | ..... | 204/98 |
| 3,755,114 A | 8/1973 | Tarjanyi et al. | ..... | 204/114 |
| 4,483,753 A | 11/1984 | Zabelin et al. | | |
| 4,804,523 A | 2/1989 | Abrams et al. | | |
| 4,839,003 A | 6/1989 | Dworak et al. | ..... | 204/98 |
| 4,909,913 A | 3/1990 | Fukuda et al. | ..... | 204/105 R |
| 5,124,012 A | 6/1992 | Berleyev | ..... | 204/180.1 |
| 5,324,396 A | 6/1994 | Ferron et al. | ..... | 204/105 R |
| 5,569,370 A | 10/1996 | Gomez | ..... | 205/560 |
| 5,814,224 A | 9/1998 | Khamizov et al. | ..... | 210/638 |

FOREIGN PATENT DOCUMENTS

JP 58-41701 * 3/1983

* cited by examiner

*Primary Examiner*—Melvyn Andrews
(74) *Attorney, Agent, or Firm*—Baker, Donelson, Bearman & Caldwell

(57) ABSTRACT

A method is disclosed wherein elemental magnesium is produced from a supply of magnesium hydroxide or other magnesium based material. The magnesium hydroxide is combined with a HI gas to produce a magnesium iodide. The resultant magnesium iodide is then heated to separate the magnesium from the iodine.

17 Claims, 6 Drawing Sheets

FIG. 7
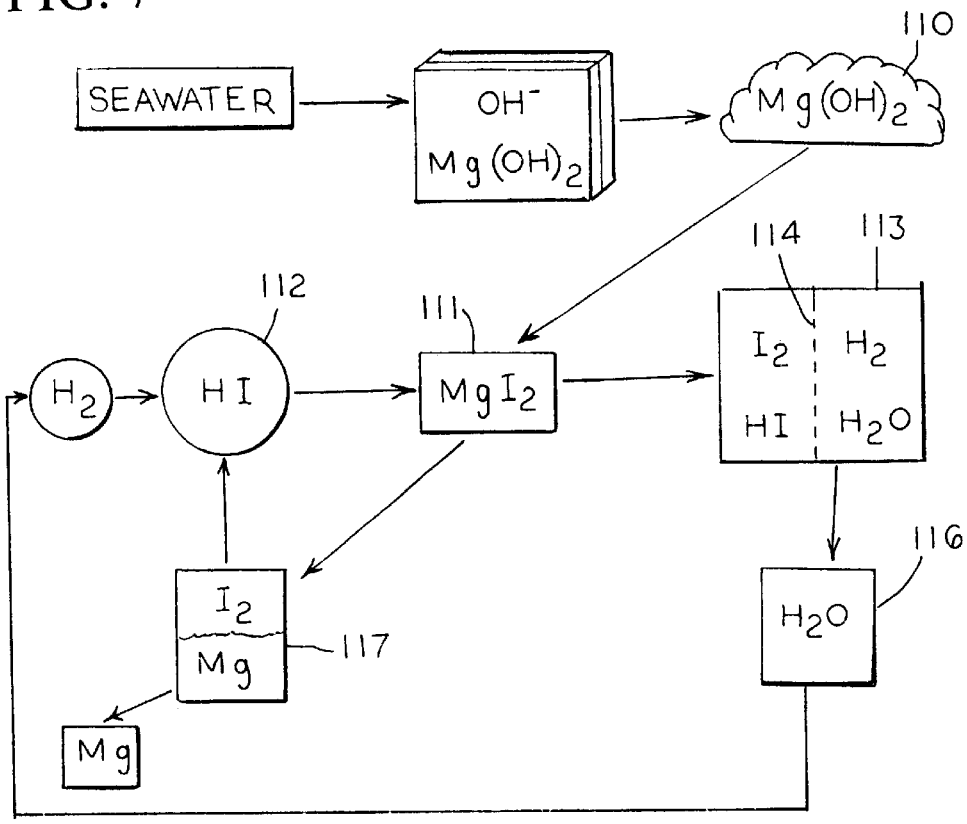
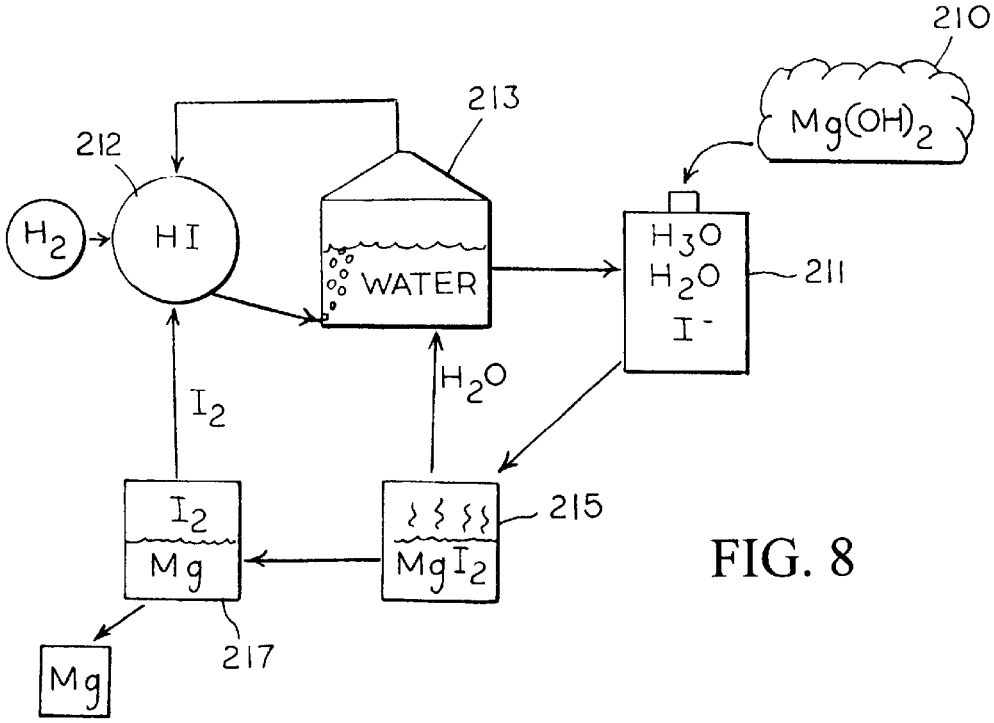
FIG. 8

METHOD FOR PRODUCING MAGNESIUM

FIELD OF THE INVENTION

This invention pertains to a method for the extraction of magnesium from seawater, brines, salinated waters or other waste streams.

GENERAL BACKGROUND

The production of magnesium from seawater, or other types of salinated water, is currently inefficient and environmentally unsound. Some attempts to produce magnesium from seawater include the use of open systems which heat a slurry until oxidation reduces it to its elemental components. Some such systems and methods are described as follows.

U.S. Pat. No. 5,124,012 issued to G. Berleyev, of Germany, on the application of F. Vomberg, discloses a process for the desalination of seawater by separating ions (Mg++, etc.) contained therein into two (2) separate solutions. At Column 5 thereof are chemical equations illustrating the production of magnesium hydroxide ($Mg(OH)_2$) and hydrogen gas ($H_2$) from magnesium (Mg) and water ($H_2O$). But here, the slurry of calcium and magnesium is heated in a open system until oxidation occurs and then reduced to elemental materials with a hydrogen reducing flame.

U.S. Pat. No. 3,250,691 issued to T. T. Broun, Jr., et al., discloses an apparatus and process for, the electrolysis of an aqueous brine or alkali metal chlorine solution wherein separate tanks created by a diaphragm or permionic membrane have an electrical current provided to a platinum-coated anode in one tank and a platinum and steel cathode in the other tank to separate positive and negative ions in the separate tanks. The current is constant and the voltage across the cell serves to drive the process.

U.S. Pat. No. 3,755,114 issued to Hooker Chemical Corporation of New York, on the application of M. Tarjanyi, et al., discloses an apparatus and process for decreasing the metallic content of a solution wherein an electrolytic cell containing an electrolyte pumped there through has a positive electrode or anode and a negative electrode or cathode separated by a diaphragm or screen and an electrical current provided to the anode and cathode to separate positive and negative ions across the diaphragm. The screens prevent the discharge of particles through the outlet.

U.S. Pat. No. 5,569,370 issued to RMG Services Pty. Ltd., of Australia, on the application of R. A. Gomez, discloses a system for the recovery of metals from metal ores wherein the reactions are carried out in separate tanks a first tank having anodes therein and a second tank having cathodes therein, the tanks being created by an electrically conductive wall. Power is provided to the anodes and cathodes to separate positive and negative ions in the separate tanks.

U.S. Pat. No. 4,909,913 issued to Toyo Soda Manufacturing Co, Ltd., of Japan, on the application of K. Fukuda, et al. , discloses, an apparatus and method for producing a metal salt by electrolysis in an electrolytic cell having separate compartments created by a diaphragm or membrane. An electrical current provided by source to the anode in one compartment and the cathode in the other compartment drives separate positive and negative ions into the separate compartments.

U.S. Pat. No. 4,804,523 issued to Bechtel Group, Incorporated, of California, on the application of J. Z. Abrams, et al., discloses a method for removing sulfur dioxide ($SO^2$) from a flue gas in fossil fuel power plants wherein seawater is used as the source of magnesium (Mg) to produce magnesium hydroxide ($Mg(OH)_2$) absorbent by reaction with hydrated lime.

U.S. Pat. No. 5,814,224 issued to Institute Geokhimii, of Moscow, on the application of R. Khamizov, et al. , discloses a method for the desalination of seawater including magnesium separation by producing concentrated magnesium carbonate ($MgCO_3$).

U.S. Pat. No. 4,483,753 issued to Vsesojuzny Institute, of the former USSR, on the application of I. V. Zabelin, et al., discloses a method of continuously extracting magnesium (Mg) from magnesium chloride ($MgCl_2$) in a multiple cell flow apparatus.

Accordingly, it is seen that a need remains for a system and method for producing magnesium from sea water in an efficient manner. It is to the provision of such therefore that the present invention is primarily directed.

SUMMARY OF THE PRESENT INVENTION

A method is now provided for producing magnesium which comprises the steps of providing a supply of magnesium based compound, combining the magnesium based compound with a HI gas to produce a magnesium iodine compound, heating the magnesium iodine compound to a temperature which creates an iodine gas from the magnesium iodine compound thereby separating the iodine from the magnesium, and removing the iodine gas from the remaining magnesium.

BRIEF DESCRIPTION OF THE DRAWING

For a further understanding of the nature and objects of the present invention, reference should be had to the following description taken in conjunction with the accompanying drawings in which like parts are given like reference numerals and, wherein:

FIG. 7 is a schematic illustrating the magnesium reduction step in an alternative form of the present invention.

FIG. 8 is a schematic illustrating the magnesium reduction step in yet another preferred form of the present invention.

DETAILED DESCRIPTION OF THE PREFERRED EMBODIMENT

Figure 1:
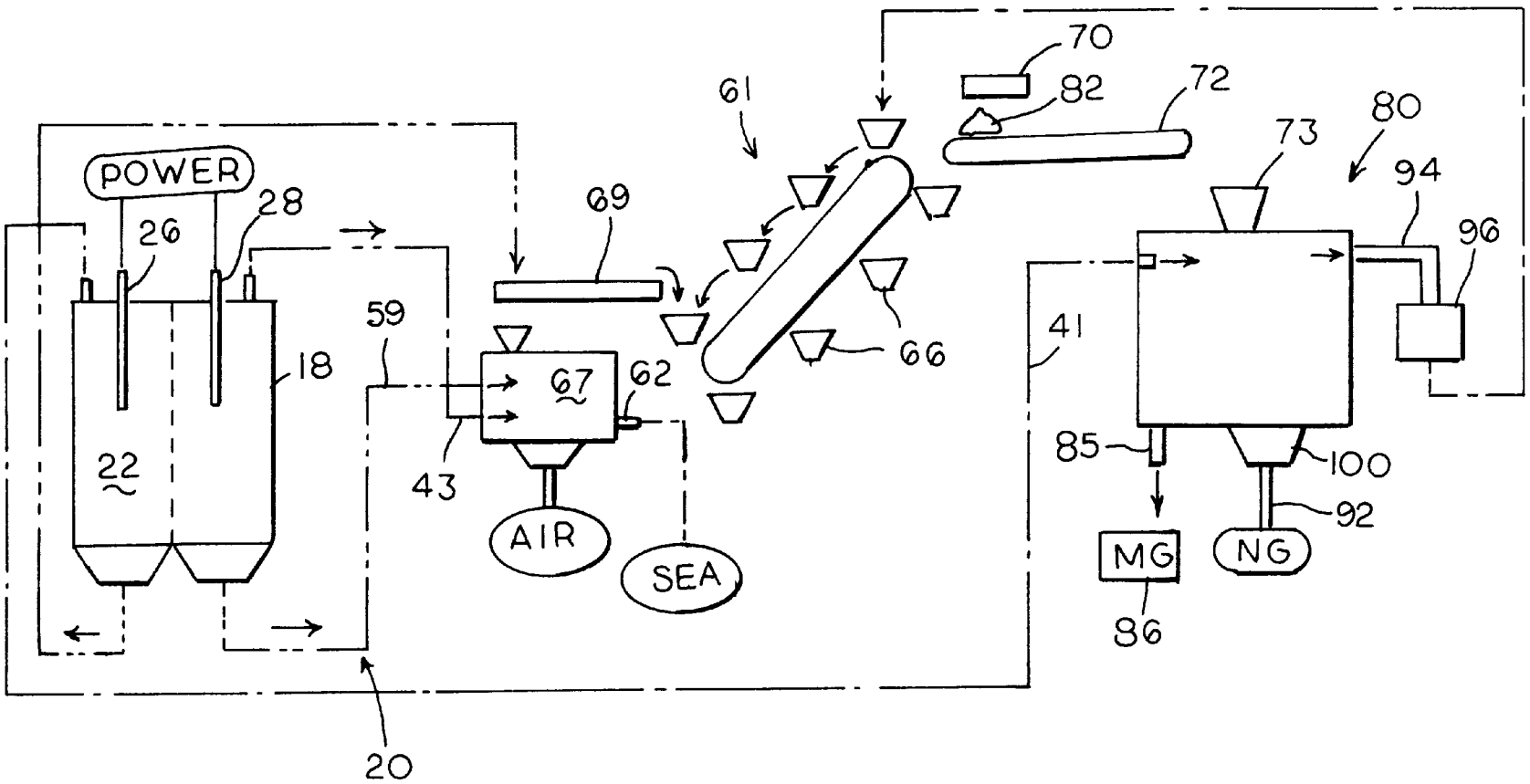
FIG. 1 is a schematic illustrating the method and system of the present invention.
Figure 2:
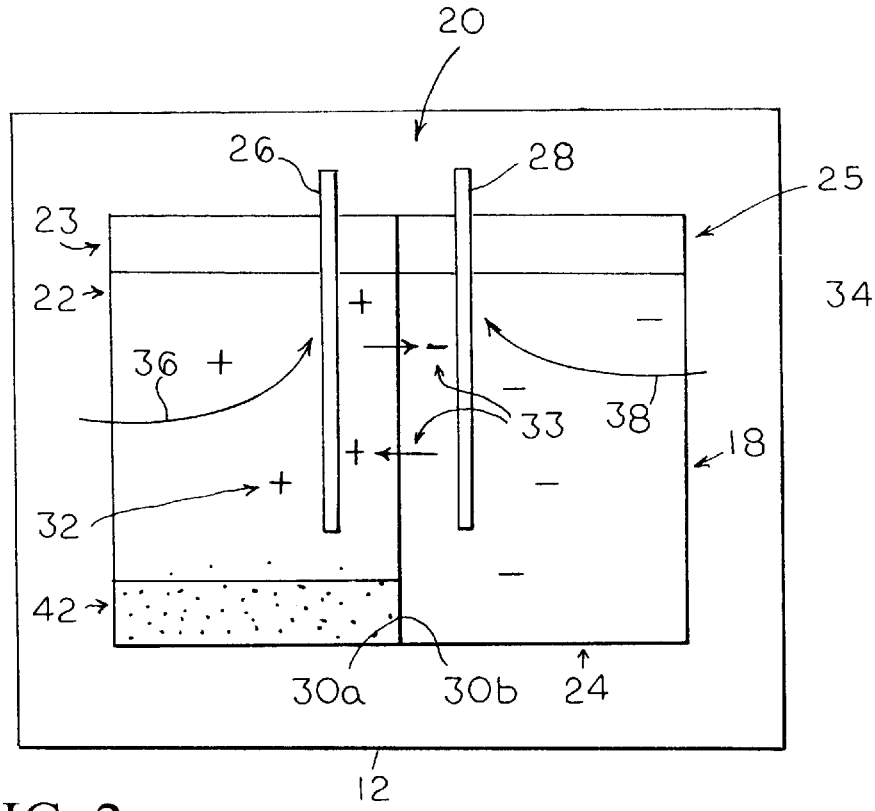
FIG. 2 is a cross-section of a basic precipitator illustrating the primary reaction of the method of the present invention at the cathode which allows separation of solid $Mg(OH)_2$ from the cathodic supernate.

Referring to the drawings, the system 10 of the present invention is schematically illustrated. Seawater is provided as a source 12 of raw material which may be provided by the open sea or a large containing area such as a tank.

The system includes a precipitator 20 having a housing 18 divided into a cathodic compartment 22 having a cathode 26 therein, preferably made of stainless steel, and an anodic compartment 24 having an anode 28 therein, preferably made of carbon. Cathodic compartment 22 and anodic compartment 24 are separated by a common wall having ion permeable membranes 30*a*, 30*b*. Such ion permeable membranes are discussed in detail in U.S. Pat. Nos. 3,755,114; 4,909,913 and 4,804,523, which are specifically incorporated herein. Membrane 30*a* is designated the cathodic ion permeable membrane while membrane 30*b* is designated an anodic ion permeable membrane. Housing 18 can be opened or closed, but by closing it fresh water can be captured as will be described further herein. Providing conventional electrical current, in the preferred range of between 2.5 volts and 12 volts, to the cathode 26 (negative) and anode 28 (positive) produces ion drift indicated by arrows 33 such that the positive ions 32 migrate through cathodic ion permeable membrane 30*a* toward cathode 26 while the negative ions 34 migrated through anodic ion permeable membrane 30*b* toward anode 28. The voltage may be used as a throttle for the speed of action and reaction. The ion drift creates OH-molecules in the cathodic compartment 22. The cathodic cell is fully charged when the majority of the anions are removed from compartment 22.

The primary reaction at cathode 26 decomposes water $2H_2O$ into hydrogen $H_2$ (g) and $(OH-)_2$ (aq). The OH− ions move from cathode 26 toward anode 28 wherein they combine with the first positive ion encountered. Hydrogen gas is produced at cathode 26 which migrates in compartment 22, in the direction of arrow 36, to hydrogen gas compartment 23, in the upper portion of compartment 22. The hydrogen gas compartment 23 has a vent 21.

The production of hydrogen gas and the increase of OH− ions continues until all Mg ions are depleted. Since the Mg++ ions have a greater ionic attraction than does the other ions within the seawater, such as Na+, K+ or the Ca++ ions, the Mg++ (aq) will combine with or take OH−(aq) away from the other compounds that have formed so as to form magnesium hydroxide. Magnesium hydroxide ($Mg(OH)_2$) participates 42 within the seawater and settles in the lower portion of compartment 22 as a solid, as it is not soluble in seawater at the ambient temperatures.

Within anodic compartment 24 the chemical reaction of the inputed elements reduces species such as chlorine gas depending on the species in solution which migrates, in a direction indicated by arrow 38, to chlorine gas compartment 25 located in the upper portion of compartment 24. Chlorine gas compartment 25 has a vent 31.

Magnesium hydroxide ($Mg(OH)_2$) 42 is pumped out of cathodic compartment 22 at outlet 27 and into pipe line 47. Pipe line 47 delivers the collected $Mg(OH)_2$ precipitates and the accompanying cathodic supernate to stage 50 for purification, as discussed in more detail hereinafter.

Figure 3:
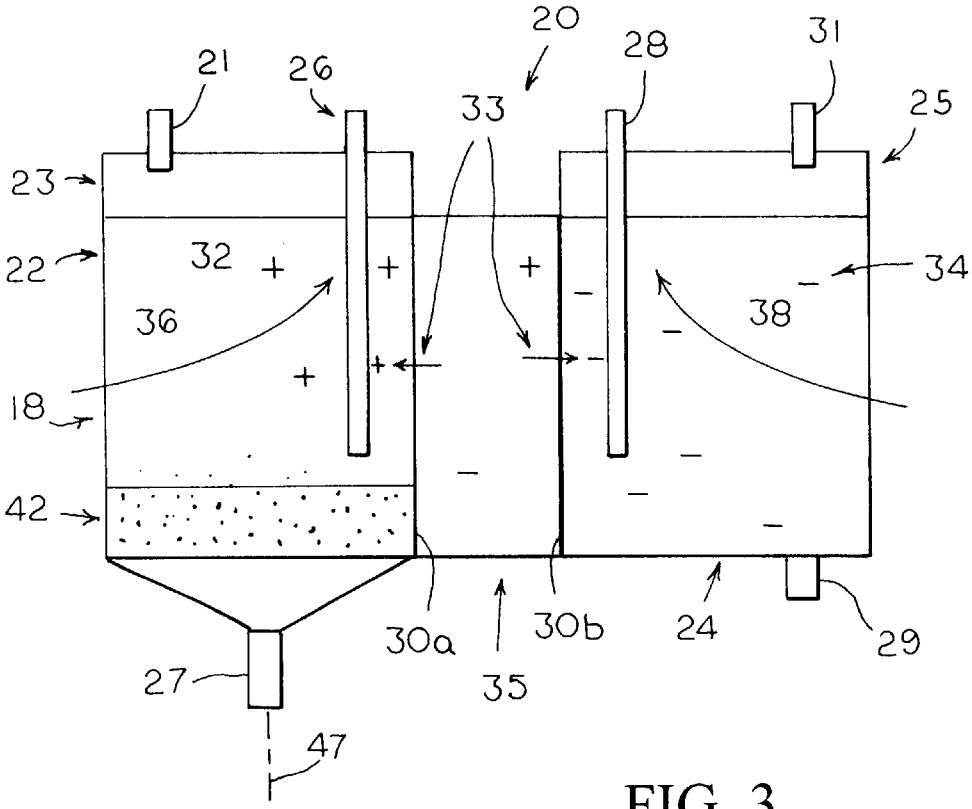
FIG. 3 is a side view in cross section of the precipitator of the present invention.
Figure 4B:
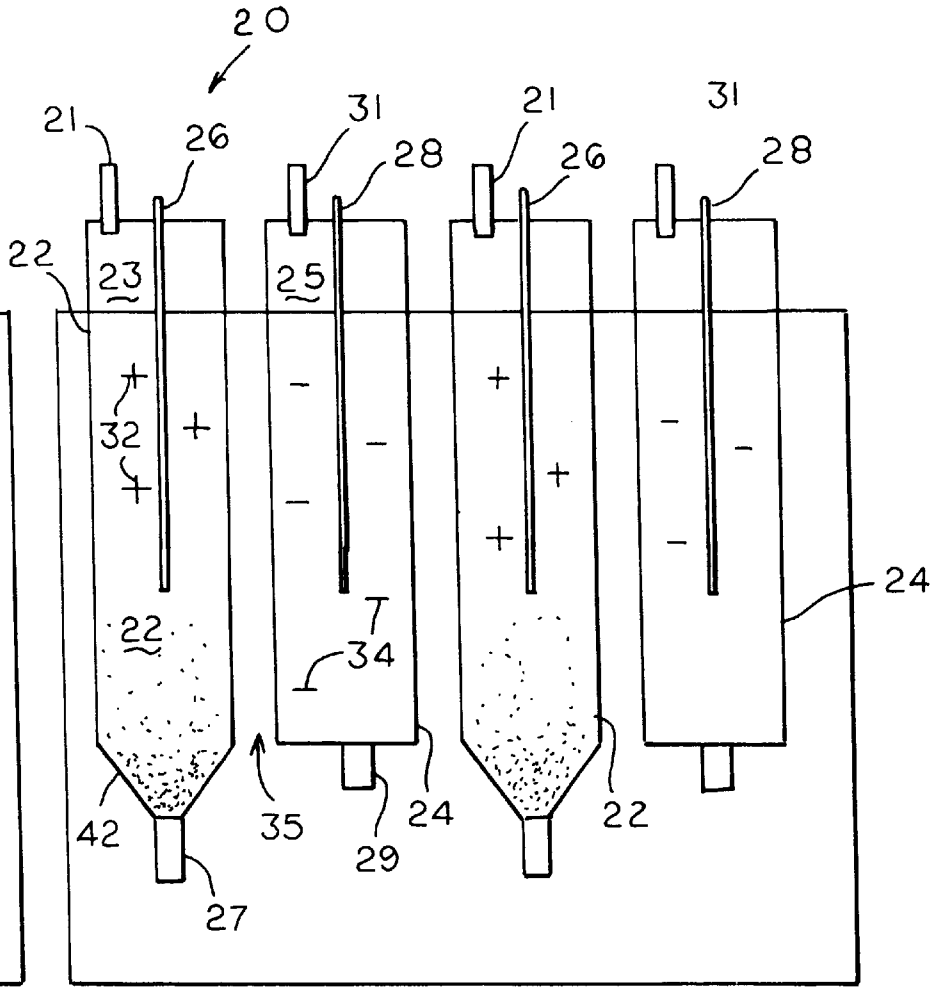
FIG. 4B is a side view of the precipitator of FIG. 4A.
Figure 4A:
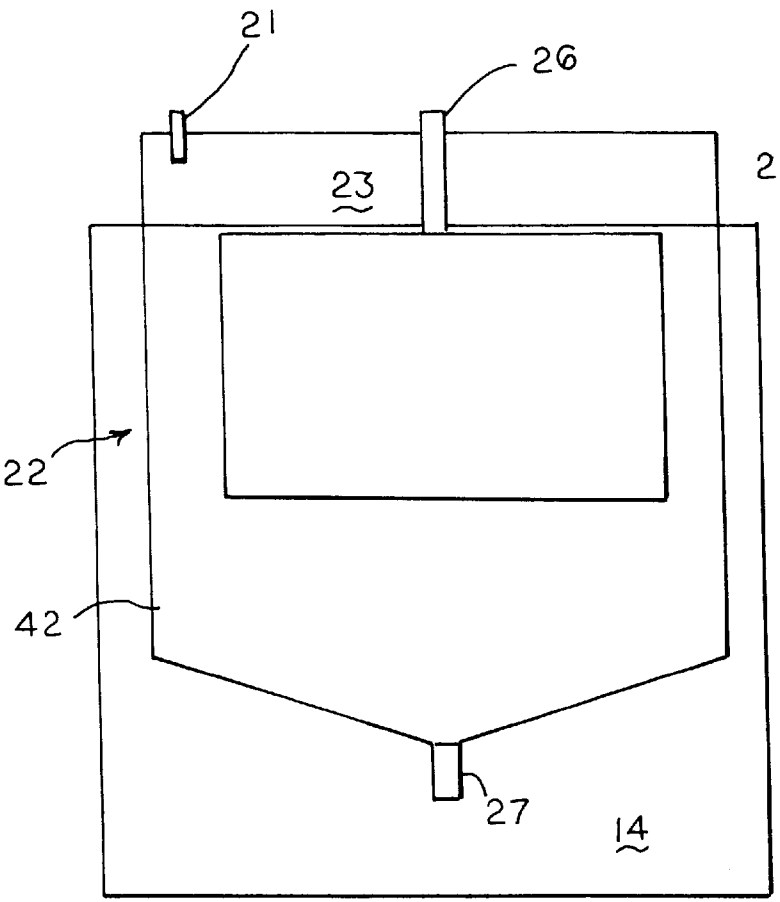
FIG. 4A is an end view in cross section of the precipitator of FIG. 3.

In an alternative embodiment, shown in FIGS. 3 and 4, it can be seen that precipitator 20 has a series of alternating or staggered cathodic and anodic compartments 22, 24. Here, the cathodic and anodic membranes are separated from each other to form a space or area 35 therebetween through which a flow of sea water passes, which allows production of magnesium hydroxide ($Mg(OH)_2$) 42 in the several compartments 22 as previously discussed. As illustrated in FIG. 4, tank 18 may contain such series of cathodic and anodic compartments 22, 24 in any orientation, as long as seawater 14 flows through areas 35 to allow ion drift described. The greater the length of compartments 22, 24, and therefore the greater the length of flow through area or space 35, the greater the collection of magnesium hydroxide ($Mg(OH)_2$) 42 in the several compartments 22.

Figure 5:
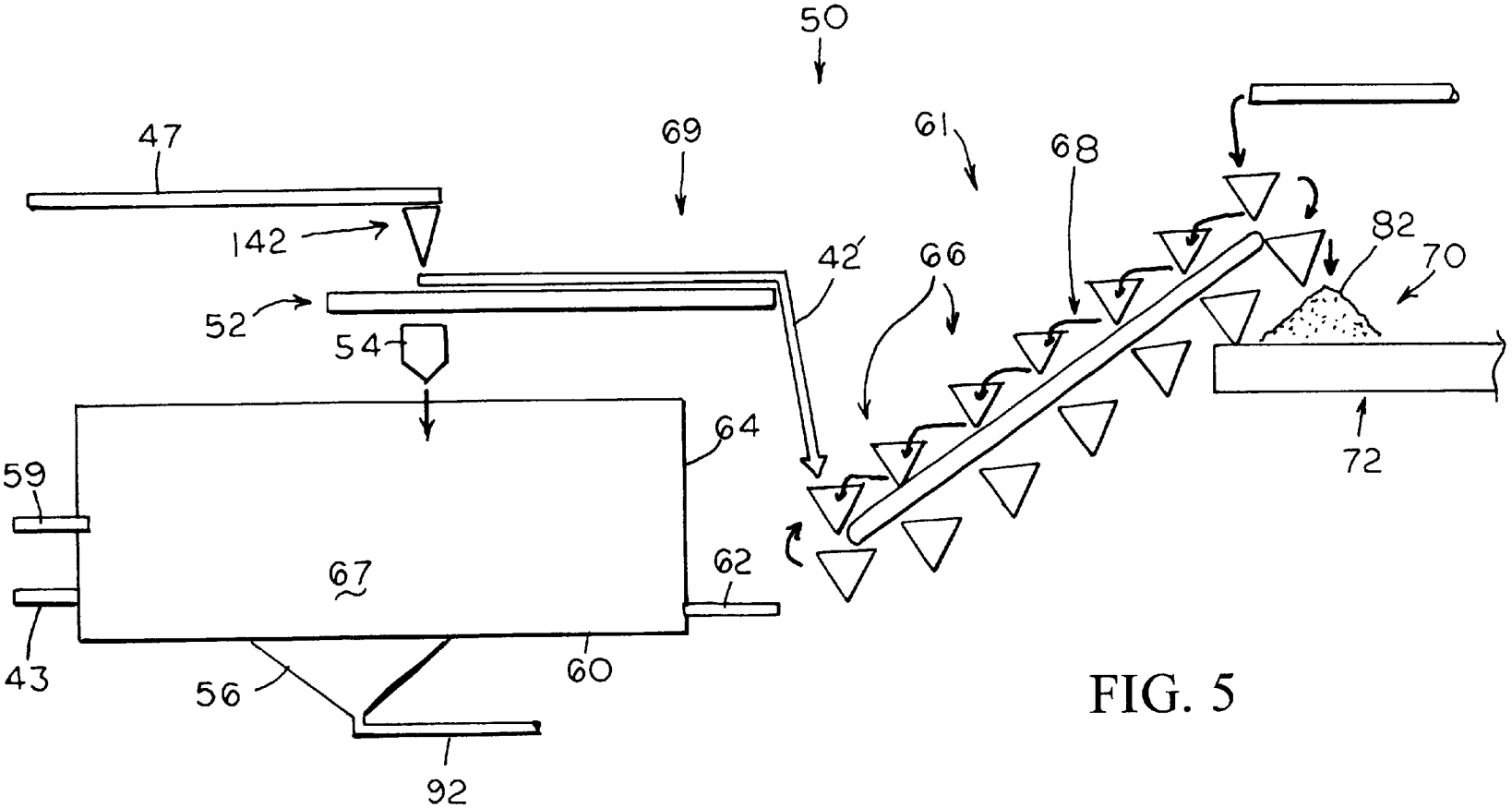
FIG. 5 is a schematic illustrating the magnesium collection, recombination and balancing steps of the method of the present invention.

Referring next to FIG. 5, at stage 50 the collected magnesium hydroxide ($Mg(OH)_2$) 42' and cathodic supernate (collectively designated as specimen 142') is deposited upon a filter 52. The $Mg(OH)_2$ 42' is filtered from the cathodic supernate by filter 52 and transported by belt 69 to a belt type washer 61. The washer 61 has an inclined, endless loop of washing tanks 66. As the magnesium hydroxide is poured into the lower most tank 66 water obtained through a process discussed hereinafter, is poured into the uppermost tank 66. This water flows in sequence through all the tanks as they move upwardly, as indicated by the arrows in FIG. 5. The washed magnesium hydroxide is then dumped from the uppermost tank 66 onto a belt 72. The belt 72 is driven past a dryer 70 which heats the magnesium hydroxide so as to remove the residual water. The dried magnesium hydroxide is transported by belt 72 to magnesium reducer 80.

Simultaneously, the cathodic supernate passes through filter 52 into collector funnel 54 which then conveys the supernate to blending tank 60. The cathodic supernate mixes in tank 60 with anode supernate delivered thereto from anodic compartments 24 through outlets 29 and pipe lines 59. Chlorine gas vented from chlorine gas compartment 25 is also delivered to tank 60 through pipe line 43.

Within blending tank 60 all of the tailings from the various processes are combined and balanced to the consistency of seawater. To this end air is pumped into the tank 60 through inlet 56 so as to bring the mixture to the consistency of seawater with a slightly higher salinity level and with less magnesium. This clean mixture 67 is removed at outlet 62 in tank 60 and returned to the source of origination.

Figure 6:
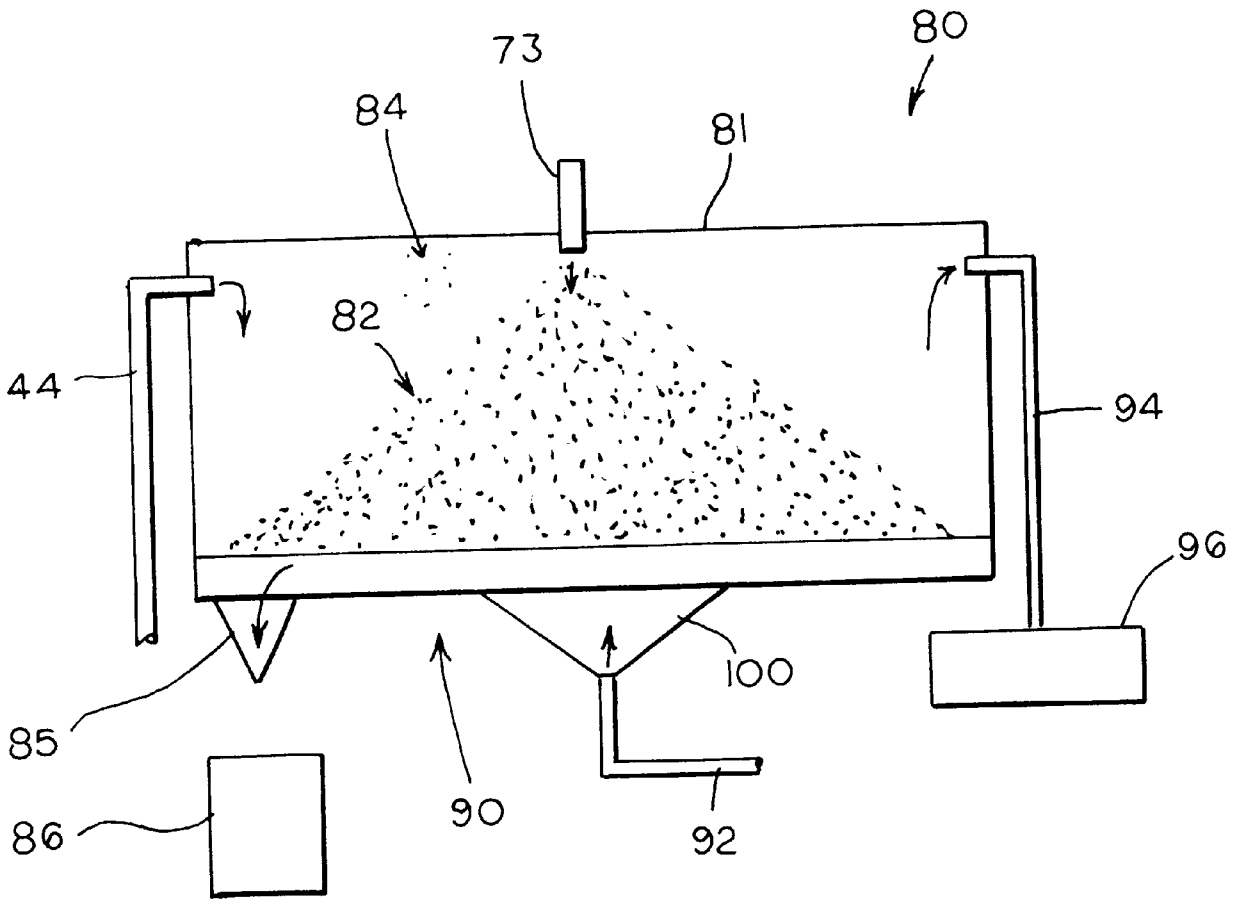
FIG. 6 is a schematic illustrating the magnesium reduction step of the method of the present invention.

Referring now to FIG. 6, magnesium reducer 80 has a tank 81 having an inlet 73 communicating with feed belt 72 so that tank 81 receives the filtered and washed magnesium hydroxide ($Mg(OH)_2$) 82 therein. Hydrogen gas, or other reducing gases, are fed into tank 81 from hydrogen compartment 23 via vent 21 and pipe line 41 at a metered rate to control the speed of the reaction, as discussed further herein. Natural gas is fed into an ignited fire chamber 100 via line 92, from an unshown source of natural gas, to heat the interior of reducer tank 81 to approximately 675° C. Within tank 81 the hydrogen gas from line 41 reduces the filtered and washed magnesium hydroxide ($Mg(OH)_2$) 82 to molten magnesium (Mg) and water vapor 84 by the following reaction:

$$H_2+Mg(OH)_2=(Mg) \text{ and } 2H_2O$$

The molten magnesium (Mg) is removed through outlet 85 so that it can be made and cooled into finished ingots, such as 86. The water vapor 84 resulting from the reduction is removed at outlet 94 and condensed as pure water within collector 96, where it may then be used for the previously described magnesium hydroxide washing process.

It should be understood that the term sea water or salinated water may be sea water, brine, salinated ground water or other similar water or aqueous solutions which contain metal ions. It should also be understood that the apparatus may operate with only a cathodic chamber with the anode positioned adjacent to the membrane to induce ion flow.

Referring next to FIG. 7, there is shown a schematic diagram of a system for reducing magnesium hydroxide 110 to magnesium in another preferred form of the invention. The magnesium hydroxide 110 is obtained through the previously described system. The magnesium hydroxide 110 is conveyed to a reaction tank 111 wherein it is combined with an over abundant supply of HI (hydrogen iodine) gas from a tank 112. The reaction between the HI gas the magnesium hydroxide under an elevated temperature yields magnesium iodide $MgI_2$.

$$2HI+Mg(OH)_2=Mg(I)_2+2H_2O$$

The gases and vapors produced through the reaction, $H_2$, HI, $H_2O$ and $I_2$, are conveyed from the reaction tank 111 to a retaining tank 113. A conventional separating membrane 114 may be utilized to separate the $I_2$ gas and the HI gas from the $H_2O$ vapor and $H_2$ gas. The $H_2O$ vapor may be condensed and collected within a water tank 116. The hydrogen gas may be conveyed back to the HI tank 112 wherein it is recombined with iodine gas to produce HI gas.

The resulting magnesium iodine compound, herein magnesium iodide $MgI_2$, is conveyed from the reaction tank 111 to a holding tank 117. The magnesium iodide within the holding tank 117 is heated to over 700 degrees Celsius, thereby causing the magnesium and iodine to separate from each other, rendering iodine gas and elemental magnesium. The iodine gas is conveyed back to tank 112 wherein it is recombined with hydrogen gas to produce the HI gas. The magnesium is conveyed from the holding tank 117 where it may be packaged and formed as ingots.

It should be understood that the just described method may be carried out in a continuous manner rather than as a batch. Also, it should be understood that the just described method may be similarly achieved with the use of other magnesium based compounds, such as MgO, rather than magnesium hydroxide.

Referring next to FIG. 8, there is shown a schematic diagram of a system for reducing magnesium hydroxide to magnesium in another preferred form of the invention. The magnesium hydroxide is obtained through the previously described system. The magnesium hydroxide 210 is conveyed to a reaction tank 211 wherein it is combined with a supply of fluid containing $H_3O$, $H_2O$ and I. This fluid (largely Hydriodic acid) is obtained by conveying HI gas from a supply tank 212 through a supply of water contained within a retaining tank 213, yielding the following reaction:

$$HI+H_2O=H_3O+I$$

The resultant of this reaction is then conveyed into the reaction tank 211. The reaction between the $H_3O$ liquid and the magnesium hydroxide yields magnesium ions and water as follows:

$$2H_3O+Mg(OH)_2=4H_2O+Mg$$

The water, magnesium and iodine ions are conveyed from the reaction tank 211 to an evaporation tank 215 wherein the magnesium combines with the iodine ions I to form $Mg(I)_2$. Heat is applied to the evaporation tank 215 so that the water evaporates, wherein the water vapor is then conveyed back to tank 213, thereby leaving $Mg(I)_2$ crystals within the evaporation tank 215. The $Mg(I)_2$ crystals are collected and conveyed to a holding tank 217.

The magnesium iodide within the holding tank 217 is heated to over 700 degrees Celsius, thereby causing the magnesium and iodine to separate from each other, rendering iodine gas and elemental magnesium. The iodine gas is conveyed back to tank 212 wherein it is recombined with hydrogen gas to produce the HI gas. The magnesium is conveyed from the holding tank 217 and processed as previously described.

It should be understood that the just described method may be carried out in a batch manner rather than as a continuous manner. Also, it should be understood that the just described method may be similarly achieved with the use of other magnesium based compounds, such as MgO, rather than magnesium hydroxide.

It thus is seen that a method and apparatus for generating magnesium from sea water is now provide. It should of course be understood that many modifications may be made to the specific preferred embodiment described herein without departure from the spirit and scope of the invention as set forth in the following claims.

What is claimed is:

1. A method of producing magnesium comprising the steps of:

(a) providing a supply of magnesium based compound;

(b) combining the magnesium based compound with a HI gas to produce a magnesium iodine compound;

(c) heating the magnesium iodine compound to a temperature which creates an iodine gas from the magnesium iodine compound thereby separating the iodine from the magnesium; and (d) removing the iodine gas.

2. The method of claim 1 wherein step (a) the magnesium based compound is $Mg(OH)_2$.

3. The method of claim 1 wherein step (a) the magnesium based compound is MgO.

4. The method of claim 1 wherein the magnesium iodine compound is magnesium iodide.

5. The method of claim 1 wherein the magnesium iodine compound is crystallized prior to step (c).

6. A method of producing magnesium comprising the steps of:

(a) providing a supply of magnesium based compound;

(b) reacting the magnesium based compound with a iodine based gas to produce a magnesium iodine compound;

(c) heating the magnesium iodine compound to a temperature which creates an iodine gas from the magnesium iodine compound thereby separating the iodine from the magnesium; and (d) removing the iodine gas from the magnesium.

7. The method of claim 6 wherein step (a) the magnesium based compound is $Mg(OH)_2$.

8. The method of claim 6 wherein step (a) the magnesium based compound is MgO.

9. The method of claim 6 wherein the magnesium iodine compound is magnesium iodide.

10. The method of claim 6 wherein the magnesium iodine compound is crystallized prior to step (c).

11. The method of claim 6 wherein step (b) the iodine based gas is HI gas.

12. A magnesium product produced in accordance with the method of:

(a) providing a supply of magnesium based compound;

(b) reacting the magnesium based compound with a iodine based gas to produce a magnesium iodine compound;

(c) heating the magnesium iodine compound to a temperature which creates an iodine gas from the magnesium iodine compound thereby separating the iodine from the magnesium; and (d) removing the iodine gas.

13. The method of claim 12 wherein step (a) the magnesium based compound is $Mg(OH)_2$.

14. The method of claim 12 wherein step (a) the magnesium based compound is MgO.

15. The method of claim 12 wherein the magnesium iodine compound is magnesium iodide.

16. The method of claim 12 wherein the magnesium iodine compound is crystallized prior to step (c).

17. The method of claim 12 wherein step (b) the iodine based gas is HI gas.

* * * * *